US005115699A

United States Patent [19]

Mertens

[11] Patent Number: 5,115,699

[45] Date of Patent: May 26, 1992

[54] CONTINUOUS DRIVE RATCHET TOOL

[76] Inventor: James H. Mertens, 4935 A Magnolia Ave., St. Louis, Mo. 63139

[21] Appl. No.: 531,909

[22] Filed: Jun. 1, 1990

[51] Int. Cl.[5] ..... B25B 13/00

[52] U.S. Cl. ..... 81/59.1; 81/60; 81/58

[58] Field of Search ..... 81/59.1, 59.4, 60, 61, 81/61.9, 58

[56] References Cited

U.S. PATENT DOCUMENTS

| | | | |
|---|---|---|---|
| 14,546 | 3/1856 | Walcott | 81/59.1 |
| 870,151 | 11/1907 | Abell | 81/59.1 |
| 1,050,583 | 1/1913 | Whitney | 81/59.1 |
| 1,372,453 | 3/1921 | Radford | 81/59.1 |
| 4,362,073 | 12/1982 | Cloud | 81/59.1 |

FOREIGN PATENT DOCUMENTS

| | | | |
|---|---|---|---|
| 0136770 | 3/1902 | Fed. Rep. of Germany | 81/59.1 |

*Primary Examiner*—Bruce M. Kisliuk
*Assistant Examiner*—Lawrence Cruz
*Attorney, Agent, or Firm*—Rogers, Howell & Haferkamp

[57] ABSTRACT

A continuous drive ratchet tool apparatus is comprised of drive disks adapted to be connected in driving engagement with a bolt head or nut threaded fastener, a disk housing having an opening extending through the housing and a bearing channel communicating with the opening, one of the drive disks being rotatably received in the opening, and a ball bearing spring biased into engagement between the disk housing opening and the one drive disk. The bearing selectively establishes a continuous driving engagement between the disk housing and the drive disk for rotating a threaded fastener in a first direction by connecting the drive disk to the fastener and rotating the disk housing in the first direction. The bearing then permits the housing to override its connection to the threaded fastener allowing the fastener to remain stationary when the disk housing is rotated in a second direction opposite to the first. The bearing also prevents any lost motion between the threaded fastener and the apparatus when rotating the apparatus to again rotate the fastener in the first direction.

15 Claims, 1 Drawing Sheet

CONTINUOUS DRIVE RATCHET TOOL

BACKGROUND OF THE INVENTION (1) Field of the Invention

The present invention relates to a continuous drive ratchet tool designed for use in turning threaded fasteners. In particular, the invention relates to a tool that is adapted to be used to turn a threaded fastener in a first direction by connecting the tool to the fastener and rotating the tool in the first direction, and to override its connection to the threaded fastener allowing the fastener to remain stationary when rotating the tool in a second direction opposite the first direction, with there being no lost motion between the threaded fastener and the tool when rotating the tool to again turn the fastener in the first direction.

(2) Description of the Related Art

Conventional overriding ratchet wrenches of the type provided by the present invention commonly comprise a drive disk assembly received in a ratchet wrench housing. The disk drive assembly is designed to selectively rotate a bolt or nut threaded fastener in a first direction by attaching a socket to the drive disk and then connecting the socket to the fastener and rotating the ratchet wrench in the first direction. The drive disk is also designed to remain stationary and override relative to the ratchet wrench housing when the wrench is rotated in a second direction opposite to the first.

The housing of a conventional ratchet wrench is commonly provided with an opening at one end, and a handle extending from the opening to the second end of the wrench. The opening is completely surrounded by a series of ratchet teeth, and the drive disk is received in the opening.

The drive disk of a conventional ratchet wrench is commonly provided with a cylinder shaped body with a rectangular post projecting from one end of the body. A detent is commonly provided on one side of the post. The post is inserted into an opening at one end of a conventional ratchet wrench socket dimensioned to receive the post, to attach the socket in driving engagement with the drive disk. The detent at the side of the post provides a releaseable means of connecting the ratchet wrench socket on the post. A spring biased pawl mechanism is pivotally mounted in the drive disk, and opposite ends of the pawl selectively project from a cylindrical sidewall of the drive disk. The spring biased pawl is commonly provided with an engagement tooth at its opposite ends. The pawl is adjusted by a manual adjustment lever provided on the wrench to cause one of the two engagement teeth at the opposite ends of the pawl to engage behind one of the ratchet teeth provided on the interior surface of the opening in the ratchet wrench housing. By selectively engaging either of the pawl teeth behind a ratchet tooth of the ratchet wrench housing, the pawl is adjusted to enable relative rotation between the drive disk and the ratchet housing in a first direction of rotation while preventing relative rotation between the disk and housing in a second direction of rotation, or to enable relative rotation between the drive disk and ratchet housing in the second direction of rotation while preventing relative rotation between the disk and housing in the first direction of rotation. The pawl is spring biased to engage between adjacent ratchet teeth of the ratchet housing to prevent the rotation of the drive disk relative to the housing when the housing is rotated in one direction, and to overcome the spring bias and cam over consecutive ratchet teeth when the ratchet housing is rotated in a second direction relative to the drive disk.

The manner of using a conventional ratchet wrench is well known in the art. In use, a selected ratchet wrench socket is first mounted on the post of the drive disk of the wrench. The socket is then placed over the threaded fastener to be turned by the wrench. With the socket and ratchet wrench connected to the threaded fastener, the operator may then rotate the wrench in the desired direction to turn the fastener.

The primary beneficial feature of the conventional ratchet wrench is that it enables the user to rotate the threaded fastener by rotating the wrench in a first direction through a predetermined arch segment, and then to rotate the wrench in the opposite direction back through that arc segment while the fastener remains stationary, to reposition the ratchet wrench to again turn the threaded fastener in the first direction. This enables the user of the ratchet wrench to incrementally turn the threaded fastener in the first direction without removing the wrench from its driving connection to the fastener, where conventional open ended or box end wrenches must be removed from the fastener and then repositioned on the fastener repeatedly when making incremental turns of the fastener.

A common disadvantage found in conventional ratchet wrenches of the type described above, is that the wrench must be turned t advance the threaded fastener through at least a minimum arc length. This enables the wrench to then be turned in the opposite direction through the minimum arc length, and cause the pawl tooth engaging between adjacent ratchet teeth of the wrench housing to ride up and completely pass over at least one ratchet tooth and engage between the next two adjacent ratchet teeth to again establish a driving connection between the drive disk and the ratchet wrench housing. As a result of this construction, the wrenches can only be used where there is sufficient clearance to enable the rotation of the wrench through the minimum arc length required to cause the pawl tooth to completely pass over at least one ratchet tooth when the wrench is rotated back after advancing the fastener.

An additional limitation often encountered in using the conventional ratchet wrench is that by connecting a ratchet wrench socket to the ratchet wrench, the wrench can only be connected in driving engagement with a threaded fastener having sufficient clearance above the fastener to permit passage of the wrench and the attached socket over and onto the fastener. If the threaded fastener is located in a confined area with insufficient room above the fastener to insert the wrench and attached socket over and onto the fastener, a ratchet wrench cannot be used to turn the fastener and a conventional open ended or box end wrench must be used.

A further disadvantage often encountered in the use of conventional ratchet wrenches is that the length of the wrench handle often prevents the use of the wrench in confined working areas. In order to use a conventional ratchet wrench to turn a threaded fastener, there must be sufficient clearance around the threaded fastener to rotate the wrench handle through the minimum arc needed to reverse the wrench rotation at the end of the driving turn and cause the wrench pawl to completely pass over one of the ratchet teeth of the wrench.

A still further disadvantage found in using conventional ratchet wrenches is that the ratchet teeth or engagement teeth at the ends of the pawl have been known to break when the wrench is used to exert a large torque on a threaded fastener.

The present invention overcomes the disadvantages of prior art ratchet wrenches discussed above by providing a continuous drive ratchet tool apparatus that is not limited in its use by a minimum arc length through which the apparatus must be rotated in order to incrementally advance a threaded fastener.

It is also an object of the present invention to provide a continuous drive ratchet tool apparatus that comprises a driving disk that is completely contained inside the housing of the apparatus to reduce its width, with a socket extending into the disk that is dimensioned to receive the head of a threaded bolt or a threaded nut.

It is a further object of the present invention to provide a series of drive disks, each provided with a socket being dimensioned to receive a different sized head of a threaded bolt or a threaded nut, enabling the apparatus to be used to turn a variety of different size fasteners.

It is a still further object of the present invention to provide a continuous drive ratchet tool apparatus including a set of replaceable handles, the handles having different dimensions to enable the ratchet tool apparatus to be used in a variety of different situations, and including a handle that adapts the apparatus to be used as a torque wrench.

It is a still further object of the present invention to provide a continuous drive ratchet tool apparatus that does not employ ratchet teeth or a pivoting pawl that are capable of breaking at high torque loads, enabling the apparatus to exert a greater torque on threaded fasteners than is possible with a conventional ratchet wrench.

SUMMARY OF THE INVENTION

The continuous drive ratchet tool apparatus of the present invention includes a drive disk that is adapted to be connected in driving engagement with a threaded fastener for turning the fastener, and a disk housing having an attached manual handle and an opening, the drive disk being received in the housing opening. The apparatus also includes a bearing assembly in the housing opening providing a means of engaging the drive disk with the disk housing to prevent relative rotation between the disk and housing in one direction of rotation, while enabling relative rotation between the disk and housing in an opposite direction of rotation.

The drive disk has a general cylindrical configuration with a side bearing surface extending completely around the circumference of the disk. A groove is formed in and completely surrounds the side surface of the disk. In a first embodiment of the disk, a rectangular post is formed unitary with and projects from one end of the disk. The post is dimensioned to receive a conventional ratchet wrench socket and in alternate embodiments has a ½" square cross section or a ⅜" square cross section to mount conventional SAE or metric sized sockets. The post can be given larger or smaller dimensions to adapt it to mount different sized ratchet wrench sockets as will be explained.

In alternate embodiments of the disk, several drive disks are provided, each having an open socket extending through the disk parallel to the disk axis. Each of the disks is adapted to be assembled in the opening of the disk housing. Each of the open sockets is dimensioned to receive a different SAE or metric sized, commercially available bolt head or nut threaded fastener.

The disk housing has an opening that extends completely through the housing. The drive disk is received in the opening. An interior wall completely surrounds the housing opening, and a rib provided on the interior wall engages in the groove of the drive disk to retain the drive disk in the housing opening. A bearing channel extends through the housing and intersects the opening at a side of the opening opposite the rib. The bearing channel is generally cylindrical, but is shaped in the form of a rectangular socket at one end where it exists from the exterior surface of the housing. First and second furrows are provided in the interior wall of the disk housing opening, and extend away from the bearing channel on opposite sides of the intersection of the bearing channel with the opening.

The rectangular socket is dimensioned to receive a ½" cross section or ⅜" cross section connecting post of a conventional ratchet wrench extension, to enable the use of the extension as the handle for the subject continuous drive ratchet tool apparatus. In alternate embodiments of the invention, a shortened handle is provided for insertion into the rectangular socket of the disk housing to provide a disk housing with an attached handle that can be held in the palm of an operator's hand when the additional leverage of an extended length handle is not needed. In still further embodiments of the invention, a conventional torque wrench or a metric sized ratchet wrench extension may be employed as the handle by inserting either the wrench or extension in the appropriate dimensioned, rectangular socket of the disk housing.

The bearing is inserted into the bearing channel through the rectangular socket and selectively engages between the groove of the drive disk and either the first or second furrow formed in the interior wall of the disk housing opening. A second bearing is inserted into the bearing channel behind the first bearing, and a coiled spring is then inserted into the channel. In an alternate embodiment of the bearing assembly, the two ball bearings and the coiled spring are replaced by a spring having a spherical projection at one end that selectively engages between the disk groove and either the first or second furrow. The channel is closed off by inserting the handle in the rectangular socket of the disk housing. The spring biases the first bearing into engagement in the groove of the drive disk, and the second bearing provides a selectively moved detent that maintains the position of the first bearing between the groove of the drive disk and either the first or second furrows in the disk housing interior wall.

By selectively positioning the first bearing in the first furrow, rotation of the drive disk relative to the disk housing in the direction of the first furrow is prevented by the engagement of the first bearing between the disk drive groove and the extension of the first furrow of the disk housing. However, positioning the first bearing in the first furrow enables the drive disk to be rotated relative to the disk housing in a direction opposite to that of the extension of the first furrow, toward the extension of the second furrow.

By selectively positioning the first bearing in the second furrow of the disk housing, the first bearing engages between the groove of the drive disk and the second furrow and prevents the rotation of the drive disk relative to the disk housing in the direction of the extension of the second furrow. However, positioning the first bearing in the second furrow enables the drive disk to be rotated relative to the disk housing in a direction opposite to the extension of the second furrow, toward the extension of the first furrow.

The above described structure of the continuous drive ratchet tool apparatus of the present invention enables the apparatus to provide a continuous driving engagement between the disk housing and the drive disk, and does not require a minimum arc length to rotate the disk housing back through to continue the incremental turning of a threaded fastener as do conventional ratchet wrenches of the prior art. The above described structure of the present invention also enables the apparatus of the invention to be inserted into confined areas and passed over and attached on the head or nut of a threaded fastener that would not be accessible to a conventional ratchet wrench assembly. The above described structure also enables the continuous drive ratchet tool apparatus of the present invention to be used in confined areas that would prohibit the rotating of the handle of a conventional ratchet wrench. Because the apparatus does not employ ratchet teeth in the disk housing opening or a pivoting pawl that have been known to break at high torque loads, the apparatus can be used to exert higher torques than conventional ratchet wrenches.

BRIEF DESCRIPTION OF THE DRAWINGS

Further objects and features of the present invention are revealed in the following detailed description of the preferred embodiments of the invention and in the drawing figures wherein.

DESCRIPTION OF THE PREFERRED EMBODIMENTS

Figure 1:
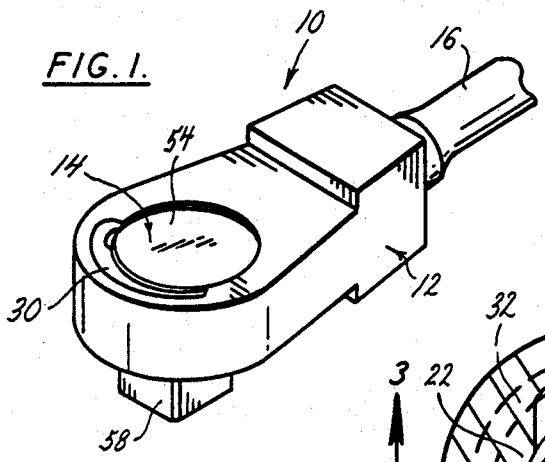
FIG. 1 is a perspective view of the continuous drive ratchet tool apparatus of the invention.
Figure 4:
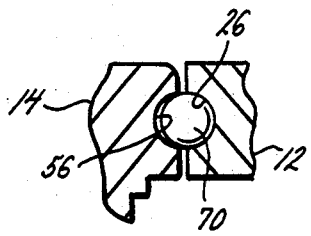
FIG. 4 is a segmented elevation view of the apparatus taken along the line 4—4 of FIG. 2.

FIG. 1 shows the continuous drive ratchet tool apparatus 10 of the present invention. The apparatus generally comprises a disk housing 12, a drive disk 14 mounted for rotation in the disk housing, a bearing assembly inside the disk housing that provides a means of rotatably supporting the drive disk in the disk housing and establishing a driving connection between the housing and disk, and a removable manual handle 16.

The disk housing 12 is provided with a large, circular opening 18 that extends completely through the housing. The opening 18 is dimensioned to receive the drive disk 14, and is defined by an interior wall 20 in the disk housing that completely surrounds the opening. The interior wall 20 is primarily smooth and cylindrical except for a rib section 22 that projects outward from a forward portion of the interior wall into the opening 18, and the intersection of a bearing channel 24 with the interior wall and first and second furrows 26, 28 formed in the interior wall 20 on opposite sides of the intersection with the bearing channel 24.

The rib section 22 serves to retain the drive disk 14 in position in the opening of the disk housing in a manner to be described. Portions of the interior wall 30, 32 above and below the rib 22 are cut away to facilitate the insertion of the drive disk 14 into the opening 18 of the disk housing 12.

The bearing channel 36 extends through the disk housing 12 from its intersection 24 with the opening 18, and exists the housing at a rearward end 38. The bearing channel 36 is substantially cylindrical along its length except for a rearward end of the channel that is formed as a rectangular socket 40 that is accessible from the rearward end 38 of the disk housing.

The rectangular socket 40 is dimensioned to receive the square cross section engaging post 42 of a conventional ratchet wrench extension t employ the extension as the handle 16 of the apparatus. In alternate embodiments of the invention, the engaging post of a torque wrench may be inserted into the rectangular socket 40 to employ the torque wrench as the handle 16 of the apparatus. In a still further embodiment of the invention, a button handle 44 having an engaging post 46 substantially identical to the engaging post of a conventional ratchet wrench extension is employed as the handle of the disk housing 12. The button handle 44 has no appreciable length and is primarily employed as a means of closing the rectangular socket 40 to maintain a bearing assembly in the bearing channel 36 in a manner to be described. The button handle 44 enables the user of the apparatus to hold the entire apparatus in the palm of their hand while using the apparatus to turn a threaded fastener. This particular handle is very useful where there is limited room for turning the apparatus. It should be clear that by replacing the handle 16 of the apparatus with the variety of different types of handles available and described above, he user of the apparatus may transform it into a variety of different types of continuous drive ratchet tools.

The drive disk 14 is generally comprised of a cylindrical shaped body having a sidewall 50 and front and back end faces 52, 54. A groove 56 is formed in the sidewall 50 of the drive disk and extends completely around its circumference. In a first embodiment of the disk, a square post 58 extends from the front face 52 and is formed unitary with the disk. The post 58 is dimensioned to receive and mount a conventional SAE or metric socket of the type used with a conventional ratchet wrench. In the preferred embodiment, the post 58 has a ½" square cross section and is provided with a spring biased detent (not shown) for retaining a socket on the post in a manner similar to that performed by the post of a conventional ratchet wrench or ratchet wrench extension. In alternate embodiments of the invention, the post 58 may have a ⅜" cross section or a cross section of other dimensions depending on the size of the ratchet wrench sockets to be used with the apparatus. A perimeter edge 60 surrounding the back face 54 of the drive disk is rounded to facilitate the insertion and removal of the disk into and out of the opening 18 of the disk housing. This enables the operator of the apparatus to replace the disk 14 with a particular disk configured to perform the task needed. For example, this enables the operator to replace a disk with a ½" post with a disk having a ⅜" post.

Figure 8:
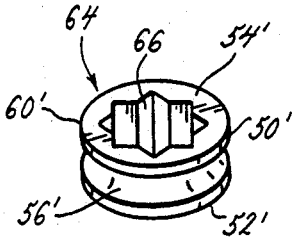
FIG. 8 is a perspective view of an alternate embodiment of a drive disk of the apparatus.
Figure 7:
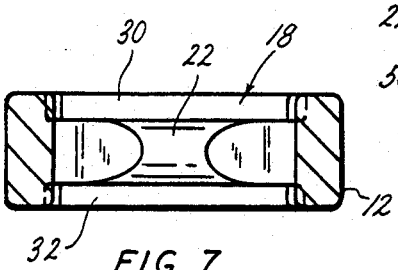
FIG. 7 is an elevation view in section of the apparatus taken along the line 7—7 of FIG. 6.

FIG. 8 shows an alternate embodiment of a drive disk 62 that may be used by the operator of the apparatus to replace the previously described drive disk 14 if so desired. This embodiment of the drive disk is substantially identical to the previously described embodiment, and includes a substantially cylindrical body with a side surface 50', and a groove 56' formed in the side surface completely surrounding the circumference of the disk. As in the previously described embodiment of the disk, this alternate embodiment also comprises front and back end faces 52', 54', with the perimeter of the back face 60' being rounded to facilitate the insertion and removal of the disk 64 into and out of the opening 18 of the disk housing 12. The alternate embodiment of the drive disk differs from the previously described drive disk in that it comprises a socket cavity 66 that extends axially, completely through the disk interior. The socket cavity 66 is configured similar to the interior of a conventional ratchet wrench socket to enable the engagement of the disk over a hexagonal or square shaped bolt head or nut threaded fastener. The threaded fastener engaging interiors of conventional ratchet wrench sockets are well known in the art, and it is common practice to provide a set of ratchet wrench sockets, each having a different interior dimension to engage the sockets in driving engagement over various different sized bolt head or nut threaded fasteners. Although only one alternate drive disk 64 is shown in the drawings, the apparatus is provided with a set of alternate drive disks. Each disk of the set has a socket cavity 66 that is dimensioned to receive, in driving engagement, a bolt head or nut of a threaded fastener of various different sizes including SAE and metric sizes. By inserting a selected drive disk from the set of alternate drive disks 64 in the disk housing 12 of the invention, the operator may employ the invention to drive a variety of different sized threaded fasteners in much the same manner as attaching a ratchet wrench socket from a separate set of sockets onto the post provided on the first embodiment of the drive disk 14. By employing the set of alternate drive disks 64 with the disk housing 12 of the invention, the width dimensions of the continuous drive ratchet tool apparatus are substantially reduced. This enables the apparatus to be employed to reach and engage over threaded fasteners in confined areas that would not be accessible if the first embodiment of the apparatus with a conventional ratchet wrench socket extending from the post 58 of the drive disk were employed. Moreover, because the structure of the alternate drive disks 64 have substantially more material surrounding the socket cavity 66 than do conventional ratchet wrench sockets, they are much less likely to break when exerting high torque on threaded fasteners.

Both of the above described embodiments of the drive disk 14, 64 are inserted into the opening 18 of the disk housing 12 by angling the disk relative to the opening 18 and inserting the back face 54, 54' of the disk first into the opening. As the disk is inserted into the opening 18, the rib section 22 of the disk housing 12 is simultaneously inserted into the groove 56, 56' of the disk. The disk is then oriented in the disk housing opening 18 with the axis of the post 58 or socket cavity 66 of the particular disk positioned parallel with the axis of the opening 18.

The disk is retained in the housing opening 18 by the rib section 22 of the opening and the bearing assembly that provides the means of establishing a bearing engagement between the disk and the disk housing. The bearing assembly is generally comprised of a first ball bearing 70, a second ball bearing 72, and a coiled spring 74. With the drive disk 14 positioned in the disk housing opening 18, the first bearing 70 is inserted through the rectangular socket 40 and the bearing channel 36 of the housing, into engagement with the circumferential groove 56 of the disk 14. The second bearing 72 is then inserted through both the rectangular socket 40 and the bearing channel 36 and engages the first bearing. The coiled spring 74 is then inserted through the rectangular socket 40 into the bearing channel 36 to bias the first and second ball bearings 70, 72 toward the housing opening 18. The entire bearing assembly is maintained in the bearing channel 36 by inserting the engagement post 42 of a conventional ratchet wrench extension 16 or a torque wrench, or the post 46 of the button handle 44 into the rectangular socket 40. In an alternate embodiment of the bearing assembly, the two ball bearings and the coiled spring are replaced by a spring having a spherical projection at one end (not shown) that selectively engages between the disk groove and either the first or second furrow.

Figure 2:
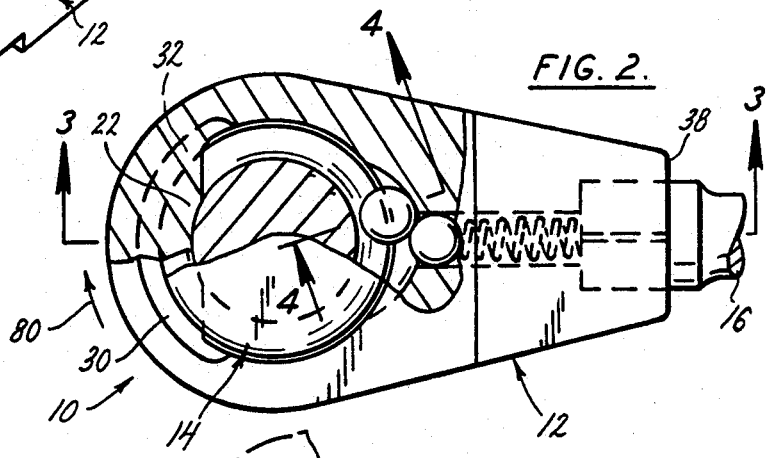
FIG. 2 is a plan view, partially in section, of the top of the continuous drive ratchet tool apparatus.
Figure 5:
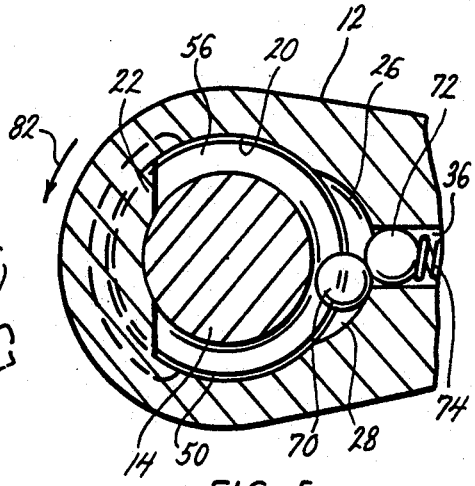
FIG. 5 is a plan view in section of the apparatus.

The engagement of the first ball bearing 70 in the groove 56 of the drive disk 14 serves to maintain the drive disk in position in the housing opening 18, and also selectively prevents the rotation of the drive disk 14 relative to the disk housing 12 in either a clockwise or counterclockwise direction as viewed in the drawing figures. With the bearing assembly assembled in the bearing channel 36 of the disk housing 12, the bias of the coil spring 74 will push the second bearing 72 toward the opening 18 and cause the first bearing 70 to move into engagement between the disk groove 56 and either the first furrow 26 (as shown in FIG. 2) or the second furrow 28 (as shown in FIG. 5) of the housing. With the first ball bearing 70 positioned in the first furrow 26 as shown in FIG. 2 the drive disk 14 is prevented from rotating counterclockwise relative to the disk housing 12 by the bearing 70. With the drive disk 14 in driving engagement with a threaded fastener (not shown), the disk is held substantially stationary by the fastener. Rotation of the disk housing 12 in a clockwise direction or in the direction of the arrow 80 shown in FIG. 2, will cause the first ball bearing 70 to roll along the extension of the first furrow 26 and wedge between the groove 56 and the extended end of the first furrow 26. This establishes a driving connection between the disk housing 12 and the drive disk 14 that will cause the disk to rotate in the clockwise direction with the housing and turn the threaded fastener.

However, with the ball bearing 70 positioned as shown in FIG. 2, rotation of the disk housing 12 in a counterclockwise direction will cause the second ball bearing 72 to push the first ball bearing 70, forcing it to rotate counterclockwise around the groove 56 of the disk and permit the disk housing 12 to override the disk 14 while the disk remains stationary. When rotating the disk housing 12 counterclockwise, the spring biased second ball bearing 72 prevents the first ball bearing 70 from passing over into the second furrow 28 and wedging between the groove 56 of the disk and the extended end of the second furrow 28.

Figure 3:
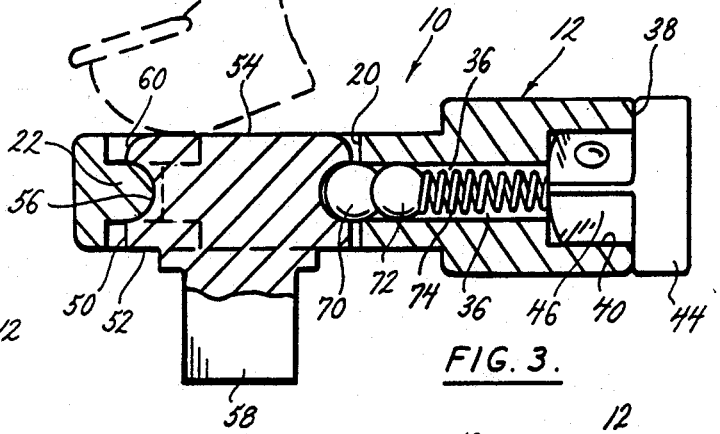
FIG. 3 is an elevation view in section of the apparatus, taken along the line 3—3 of FIG. 2.
Figure 6:
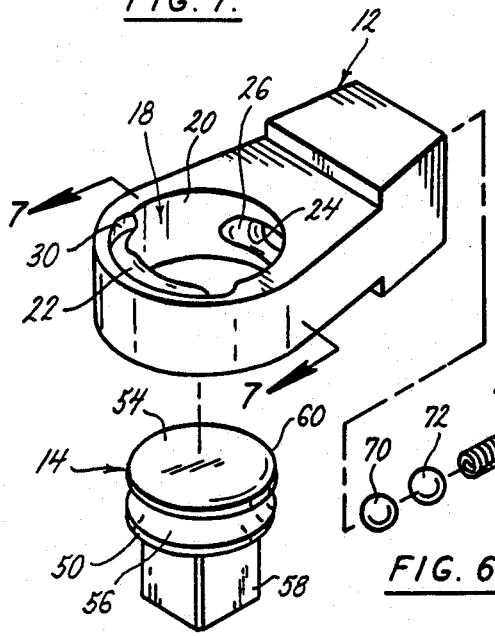
FIG. 6 is an exploded perspective view of the apparatus.
Figure 6:
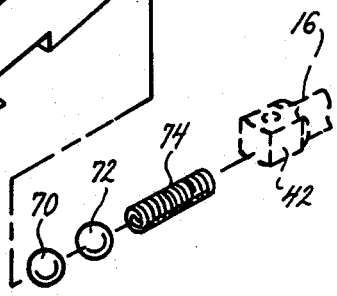

In order to reposition the first ball bearing 70 in the second furrow 28 to establish a counterclockwise driving connection between the disk housing 12 and the drive disk 14, the operator need only depress the back face 54 of the disk as shown in FIG. 3, while rotating the drive disk clockwise relative t the disk housing. By depressing the back face of the disk, the operator establishes a friction engagement between the top surface of the first bearing 70 and the top surface of the groove 56 and the bottom surface of the bearing 70 and the bottom surface of the first and second furrows 26, 28 as viewed in FIG. 3. By then rotating the disk 14 clockwise relative to the disk housing 12, the first ball bearing 70 is caused to walk along the bottom surface of the furrow 26 and depress the second ball bearing 72 into the bearing channel 36 against the bias of the spring 74. As the first ball bearing 70 walks clockwise past the second ball bearing 72, it enters into the second furrow 28 and the second ball bearing 72 is biased back into a position behind the first ball bearing 70 as shown in FIG. 5, and retains the first ball bearing 70 in position between the groove 56 of the drive disk 14 and the second furrow 28 of the disk housing 12. On continued rotation of the disk housing counterclockwise relative to the drive disk 14, the first ball bearing wedges between the disk groove 56 and the extended end of the second furrow 28. This establishes a driving engagement between the disk 14 and the housing 12 that causes the disk 14 to rotate counterclockwise as viewed in FIG. 5 when the disk housing 12 is rotated by the operator counterclockwise.

In this second position of the first ball bearing 70 shown in FIG. 5, the bearing prevents relative rotation between the drive disk 14 and the disk housing 12 when rotating the disk housing in a counterclockwise direction or in the direction of the arrow 82. However, the position of the first ball bearing 70 in the second furrow 28 will permit the disk housing 12 to override the drive disk 14 and rotate clockwise relative to the drive disk.

To reposition the first ball bearing 70 to establish a clockwise driving connection between the drive disks 14 and the disk housing 12, the operator need only repeat the procedure of depressing the back face 54 of the disk while rotating the disk housing 12 counterclockwise relative to the disk. This will reposition the first bearing 70 on the opposite side of the second bearing 72 and in the first furrow 26.

To replace the drive disk 14 retained in the opening 18 of the disk housing 12 with a disk having a different size post or with one of the alternate drive disks 64, the operator need only remove the socket wrench extension handle 16 or button handle 44 from the rectangular socket 40 at the rearward end 38 of the housing, and remove the coil spring 74 and the two ball bearings 70, 72 from the bearing channel 36. The drive disk 14 may then be angled in the disk housing opening 18 to remove the disk from the opening and permit its replacement by the desired drive disk.

From the description of the invention above, it is seen that the continuous drive ratchet tool apparatus is capable of continuously turning a threaded fastener, with no lost motion between the drive disk 14 and the disk housing 12 of the apparatus when turning the threaded fastener in either a clockwise or counterclockwise direction. The replaceable drive disk of the apparatus adapt it to be used in a variety of different situations and environments. The replaceable handles 16 of the apparatus also provide the additional leverage for turning the apparatus when needed, and the convenience of being able to reduce the overall length of the apparatus so that it may be held in the palm of an operator's hand when turning a threaded fastener. Because the apparatus does not employ ratchet teeth in the disk housing or pivoting pawl in the drive disk that could break when exerting a high torque on a threaded fastener, the apparatus is capable of exerting higher torques than conventional ratchet wrench assemblies.

While the present invention has been described by reference to specific embodiments, it should be understood that modifications and variations of the invention may be constructed without departing from the scope of the invention defined in the following claims.

I claim:

1. A continuous drive ratchet tool apparatus comprising:

a drive disk adapted to be connected in engagement with a threaded fastener for turning the fastener, the disk having a side surface extending around its circumference;

a disk housing having an opening therein and having an interior wall with a projection means thereon, the drive disk being received in the opening and the projection means engaging in the side surface of the drive disk; and a first ball bearing in the housing opening and engaging the side surface of the drive disk, the first ball bearing selectively enabling either rotation of the drive disk in a first direction relative to the disk housing while preventing rotation of the disk in a second direction relative to the housing, or said first ball bearing enabling rotation of the drive disk in the second direction relative to the housing while preventing rotation of the disk in the first direction relative to the housing.

2. The apparatus of claim 1, wherein:

the drive disk side surface is a bearing surface.

3. The apparatus of claim 1, wherein:

the side surface of the drive disk has a groove formed therein, and the groove extends completely around the circumference of the drive disk.

4. The apparatus of claim 1, wherein:

the drive disk has a socket formed therein, the socket being adapted to receive a bolt or nut threaded fastener in driving engagement.

5. The apparatus of claim 1, wherein:

a bearing channel is formed in the disk housing intersecting the housing opening;

a second ball bearing is received in the bearing channel; and a biasing means is provided in the bearing channel and biases the second ball bearing out of the channel and into engagement with the first ball bearing, thereby forcing the first ball bearing into engagement with the side surface of the drive disk.

6. The apparatus of claim 1, wherein:

the disk housing is provided with a socket and a handle inserted therein, the handle having a short length to enable the disk housing and handle to fit in a palm of a hand of an operator of the apparatus.

7. The apparatus of claim 1, wherein:

the drive disk is removable from the opening of the disk housing, enabling replacing the disk with another disk.

8. The apparatus of claim 1, wherein:

the drive disk has a post formed thereon adapted to mount a ratchet wrench socket.

9. The apparatus of claim 1, wherein:

the disk housing is provided with a socket and a handle inserted therein, the handle has a predetermined length to provide leverage for rotating the disk housing and the drive disk when turning a threaded fastener.

10. The apparatus of claim 9, wherein:

the handle is a ratchet wrench extension.

11. The apparatus of claim 1, wherein:

the disk housing interior wall surrounds the opening, and the first ball bearing is positioned between the interior wall and the side surface of the drive disk, the first ball bearing engaging between the interior wall and side surface to selectively prevent rotation of the drive disk relative to the disk housing in either the first or second direction.

12. The apparatus of claim 11, wherein:

the side surface of the drive disk has a groove formed therein, and the first ball bearing engages in the groove and retains the drive disk in the opening of the disk housing.

13. The apparatus of claim 11, wherein:

the projection means includes a rib that projects from the interior wall of the disk housing into the opening, and the rib engages in the groove of the drive disk and retains the drive disk in the opening of the disk housing.

14. The apparatus of claim 11, wherein:

a first and a second furrow are formed in the interior wall of the disk housing, the first bearing engages between the first furrow and the side surface of the drive disk to prevent rotation of the disk relative to the disk housing in the first direction, and the first bearing engages between the second furrow and the side surface of the drive disk to prevent rotation of the disk relative to the disk housing in the second direction.

15. A continuous drive ratchet tool apparatus comprising:

a drive disk adapted to be connected in engagement with a threaded fastener for turning the fastener;

a disk housing having an opening therein and having an interior surface with a rib provided thereon, the drive disk being received in the opening and the rib engaging with the drive disk to retain the drive disk in the disk housing opening; and a single ball bearing in the disk housing opening and engaging between the disk drive and the disk housing, the bearing selectively enabling either rotation of the drive disk in a first direction relative to the disk housing while preventing rotation of the disk in a second direction relative to the housing, or enabling rotation of the drive disk in the second direction relative to the housing while preventing rotation of the disk in the first direction relative to the housing.

* * * * *